US005560872A

United States Patent [19]

Rahman et al.

[11] Patent Number: 5,560,872

[45] Date of Patent: Oct. 1, 1996

[54] COMPOSITIONS COMPRISING OXAZOLIDINE AND TETRAHYDROOXAZINE AMIDE SURFACTANTS

[75] Inventors: Mohammad A. Rahman, River Edge; Shang-Ren Wu, Mahwah, both of N.J.; Anthony Hung, New City, N.Y.

[73] Assignee: Lever Brothers Company, New York, N.Y.

[21] Appl. No.: 444,335

[22] Filed: May 18, 1995

[51] Int. Cl.[6] ..... C11D 1/66; C11D 3/28

[52] U.S. Cl. ..... 510/392; 544/97; 548/215; 510/137; 510/151; 510/159; 510/320; 510/321; 510/136; 510/374; 510/393

[58] Field of Search ..... 544/97; 548/215; 510/542, 548

[56] References Cited

U.S. PATENT DOCUMENTS

| | | | |
|---|---|---|---|
| 2,662,073 | 12/1953 | Mehltretter et al. | 260/102 |
| 3,825,555 | 7/1974 | Lajiness | 260/307 F |
| 3,897,425 | 7/1975 | Bodor et al. | 260/244 R |
| 4,965,368 | 10/1990 | Teach | 548/215 |
| 5,009,814 | 4/1991 | Kelkenberg et al. | 252/548 |
| 5,136,060 | 8/1992 | Holton | 549/510 |
| 5,389,279 | 2/1995 | Au et al. | 252/108 |
| 5,428,172 | 6/1995 | Taylor et al. | 546/275 |

FOREIGN PATENT DOCUMENTS

| | | |
|---|---|---|
| 1150620 | 4/1969 | United Kingdom . |
| 1401768 | 7/1975 | United Kingdom . |
| 92/06157 | 4/1992 | WIPO . |

OTHER PUBLICATIONS

Bergmann, Chemical Reviews vol. 53 pp. 309–352 (1953) No month available.

*Primary Examiner*—Paul Lieberman
*Assistant Examiner*—Michael P. Tierney
*Attorney, Agent, or Firm*—Ronald A. Koatz

[57] ABSTRACT

The present invention relating to compositions comprising novel oxazolidine and tetrahydrooxazine amide surfactants and to processes for making the surfactants. These are cyclic surfactants having good solubility and which are readily biodegradable.

10 Claims, No Drawings

COMPOSITIONS COMPRISING OXAZOLIDINE AND TETRAHYDROOXAZINE AMIDE SURFACTANTS

BACKGROUND OF THE INVENTION

The present invention relates to both detergent compositions as well as personal wash compositions comprising novel oxazolidine amide (5 member ring) and tetrahydrooxazine amide (6 member ring) surfactants and to methods for preparing the surfactants. These surfactants are biodegradable, sugar-based surfactants.

It has in recent years become a highly desirable goal in the art to find surfactants which are environmentally friendly and preferably not tremendously expensive. Carbohydrate based surfactants are good candidates in this regard because they offer the possibility of cheap, renewable and biodegradable surfactants Several carbohydrate based amide surfactants are known in the art.

In U.S. Pat. No. 5,389,279 to Au et al., for example, there are taught certain aldobionamide compounds. These compounds are structurally different than the compounds of the subject invention.

U.S. Pat. No. 5,009,814 to Kelkenberg et al. provides N-polyhydroxyalkyl fatty acid amides used as thickeners in aqueous surfactant systems and having the formula:

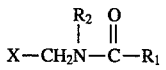

wherein $R_1$ is alkyl, $R_2$ is hydrogen, alkyl or hydroxy alkyl and X is a polyhydroxy group.

A series of Procter and Gamble references teach various compositions which comprise polyhydroxy amides. WO-92/06172, for example, teaches built liquid detergent compositions containing polyhydroxy fatty acid amides. There are about 20 references reciting various compositions containing the same polyhydroxy amides.

The polyhydroxy fatty acid amides are generally linear structures (i.e., wherein the polyhydroxy group is derived from monosaccharides such as in the case of N-methyl glucamide). Such linear structures would be expected to have strong intermolecular interactions leading to, for example, higher Krafft points and therefore be less soluble than cyclic surfactants such as the compounds of the invention (Krafft point is a measure of solubility; specifically, it is the temperature at which the solubility of the nonionic surfactant becomes equal to the critical micelle concentration). Even if the polyhydroxy fatty amide is a disaccharide, these compounds still have an extended linear structure within the molecule which differs from the molecules of the invention.

Polyhydroxy fatty acid amides with a reverse amide link from the polyhydroxy fatty acid amides noted above (e.g., N-alkyl gluconamides of general structure $HOCH_2(CHOH)_4CONHR$) are also known in the art, for example, in U.S. Pat. No. 2,662,073 to Mehltretter et al. As noted, these are either linear structures which would be expected to have higher Krafft points (i.e., be less soluble) than cyclic compounds; or they have extended linear structures within the molecules which would also be expected to raise the Krafft point.

Thus, it would be advantageous to find a carbohydrate based surfactant with a structure providing greater solubility. In addition, it is always desirable to find a novel, carbohydrate surfactant, whether or not it has a cyclic structure.

SUMMARY OF THE INVENTION

The present invention relates to detergent compositions and personal product compositions comprising carbohydrate surfactants having one of the general structures set forth as in compound I below:

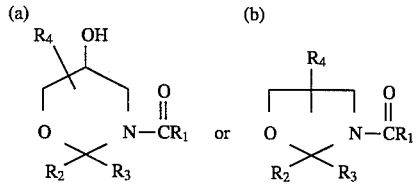

(I)

wherein:

$R_1$ is a linear or branched, saturated or unsaturated hydrocarbon group (i.e., alkyl or alkenyl) having 1 to 50 carbons, preferably 1 to 40, more preferably 8 to 24 carbons; the alkyl or alkenyl group may be interrupted with heteroatoms such as, for example, oxygen, sulfur or nitrogen;

$R_2$ and $R_3$ are hydrogen or a linear or branched, saturated or unsaturated hydrocarbon group (i.e., alkyl or alkenyl) having 1 to 50 carbons, preferably 1 to 40, more preferably 8 to 24; (the combination of $R_1$, $R_2$ and $R_3$ should be at least $C_8$) and;

$R_4$ in general, will be whatever group was originally attached to the reducing sugar prior to the reductive amination which formed the intermediate amino sugars (e.g., glucosamines or glucamines) which intermediate amino sugars are in turn cyclized to form either the 5 member oxazolidine or 6 member tetrahydroxazine prior to amidation. It should be noted from the structure that the $R_4$ group may be attached at varying places in the ring depending on the starting reducing sugars or amino sugars.

$R_4$, for example, may be hydrogen in the case of the 6-member ring or $CH_2OH$ in the case of the 5-member ring when the starting sugar is glyceraldehyde Suitable reducing sugars (starting sugars) which will define $R_4$ include glucose, fructose, maltose, lactose, galactose, mannose, xylose, erythritose and as noted above, glyceraldehyde. Starting amino sugars could include glucamine or glucosamine. As raw materials, high dextrose corn syrup, high fructose corn syrup, and high maltose corn syrup can be utilized as well as the individual sugars listed above. These corn syrups may yield a mix of sugar components for use in yielding the final $R_4$. It should be understood that it is by no means intended to exclude other suitable raw materials.

The $R_4$ group preferably will be selected from the group consisting of $—(CHOH)_n—CH_2OH$ where n is an integer from 1 to 5;

Most preferred depends on whether the resulting compound is compound (a) or (b). In the case of (a), preferably n=2 and in the case of (b), preferably n=3. Depending on the starting sugar, $R_4$ can also be any saccharide or residual saccharide structure.

In a specific embodiment of the invention, the compound used in the compositions has one of the following structures:

(a) (b) (I)

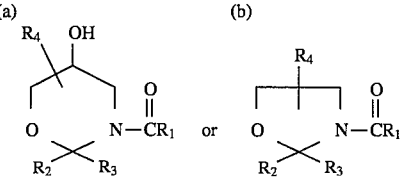

wherein $R_4$=—$(CHOH)_{n'}$—$CH_2OH$, where, when it is structure (b), n' equals 3; and, when it is structure (a), n' equals 2; and $R_1$, $R_2$ and $R_3$ are as defined as in compound (I), (a) and (b) above Other preferred embodiments of the invention include, but are not limited to:

(1) $R_2$=$R_3$=Hydrogen; and $R_1$=$C_{11}$ to $C_{17}$; and (2) $R_2$=Hydrogen; $R_1$=$CH_3$; an $R_3$=$C_{11}$ to $C_{17}$ One requirement of the invention is that the combination of $R_1$, $R_2$ and $R_3$ should equal $C_8$ or greater, preferably $C_{12}$ to $C_{30}$.

DETAILED DESCRIPTION OF THE INVENTION

The present invention relates to compositions comprising novel carbohydrate surfactants having one of the formula set forth below:

(a) (b) (I)

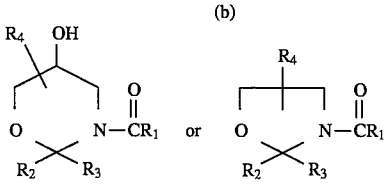

wherein:

$R_1$ is a linear or branched, saturated or unsaturated alkyl or group (i.e., alkyl or alkenyl) having 1 to 50 carbons, preferably 1 to 40, more preferably 8 to 24 carbons;

$R_2$ and $R_3$ are hydrogen or substituted or linear or branched, saturated or unsaturated alkyl groups having 1 to 50 carbons, preferably 1 to 40, more preferably 8 to 24; and $R_4$ is whatever group was originally attached to the reducing sugar prior to the reductive amination which formed the intermediate amino sugar (the amino sugar, e.g., glucamine or glucosamine, may also be used directly as a bulk or preformed starting material) which starting or intermediate amino sugar is in turn cyclized to form the 5-member oxazolidine or 6-member tetrahydroxazine prior to amidation.

The $R_4$ group may be attached at various locations in the ring, as noted from the structure, depending on the starting reducing sugar or amino sugar.

$R_4$ for example, may be hydrogen or $CH_2OH$, when starting sugar is glyceraldehyde depending on whether the five or six member ring is formed (i.e., hydrogen in case of 6 member ring and $CH_2OH$ in the case of the 5 member ring).

Suitable reducing sugars which define what $R_4$ will ultimately become include glucose, fructose, maltose, lactose, galactose, mannose, xylose, erythritose as well as glyceraldehyde. The starting material, as noted above, may also be a bulk or pre-made amino sugar product such as glucamine or glucosamine. As raw materials, high dextrose corn syrup, high fructose corn syrup, and high maltose corn syrup can be utilized as well as the individual sugars listed above. These corn syrups may yield a mix of sugar components for use in yielding the final $R_4$. It should be understood that it is by no means intended to exclude other suitable raw materials. The final $R_4$ preferably will be selected from the group consisting of —$(CHOH)_n$—$CH_2OH$ where n is an integer from 1 to 5, inclusive. Most preferred depends on whether the resulting compound is the five or six membered compound. In the five membered compound n=3 and, in the six membered compound n=2. Again, depending on the starting sugar or amino sugar, $R_4$ can be any polysaccharide or residual polysaccharide structure.

In one embodiment of the invention, the compound used in the compositions has the following structure:

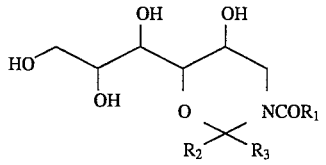

wherein $R_1$=a $C_1$ to $C_{50}$ alkyl group as defined above; and $R_2$, $R_3$=H or $C_1$ to $C_{50}$ alkyl group as defined above.

$R_1$+$R_2$+$R_3$ should be at least $C_8$, preferably at least $C_{12}$, more preferably $C_{12}$ to $C_{24}$.

In a preferred embodiment of the invention, $R_2$ and $R_3$ are hydrogen or $C_1$ to $C_4$ alkyl and $R_1$ is a $C_8$ to $C_{24}$ straight chain.

In another preferred embodiment, either $R_2$ and $R_3$ is $C_8$ to $C_{24}$ alkyl and $R_1$ is a $C_1$ to $C_6$ shod chain alkyl group. While not wishing to be bound by theory, it is believed that enhanced surfactancy properties will be realized if, when either one of $R_1$, $R_2$ or $R_3$ is long chained, than the others are shod chained (i.e., only one long chain is required).

In another preferred embodiment the compound has the following structure:

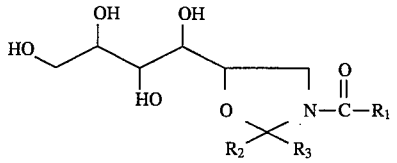

wherein $R_1$=$C_1$ to $C_{50}$ alkyl as defined above;

$R_2$, $R_3$=H or $C_1$ to $C_{50}$ alkyl group as defined above.

$R_1$ plus $R_2$ plus $R_3$ should be at least $C_8$, preferably $C_{12}$ to $C_{30}$, more preferably $C_{12}$ to $C_{24}$ Preferably:

$R_1$=$C_1$ to $C_4$ straight chain alkyl; and $R_2$ or $R_3$ is $C_8$ to $C_{24}$ straight chain alkyl In another embodiment of the invention, the present invention is concerned with a method for preparing the novel surfactants used in the compositions described above.

General Method for the Preparation of Oxazolidine Amide

The oxazolidine amides were synthesized by the reaction of available sugar amine such as for example glucamine (e.g., 1-Amino-1deoxysorbitol) with various long chain aldehydes (e.g., fatty aldehyde). Glucamine is synthesized by reductive amination of glucose and ammonia. The sugar amine (e.g.. glucamine) was dissolved in a solvent such as anhydrous methanol and refluxed (for 12 to 24 hours with stirring) to form a clear solution. Other suitable solvents include ethanol, propanol, isopropanol, ethylene glycol, propylene glycol, ethylene glycol monomethyl ether and diethylene glycol. Equimolar amounts of fatty aldehyde were added and refluxed in solvent (anhydrous methanol) with an acid catalyst. Suitable catalyst include, but are not limited to sulfonic acids such as p-toluenesulphonic acid, methanesulfonic acid or, alkyl benzenesulfonic acid; and acid resins such as Amberlite IR-120 ( for example, ex. Aldrich). The amidation step (in the same reaction vessel) involved cooling the reaction to about 10° C. to 25° C. with an ice bath and adding 1.0 to 1.5 equivalent of anhydride. Suitable anhydrides include any component of formula:

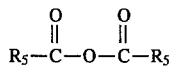

where $R_5$ is $C_1$ to $C_{30}$, preferably $C_1$ to $C_4$.

The solvent was removed under reduced pressure and the crude product purified by washing with, for example, hexanes and recrystallization in acetone or ethyl acetate.

General Methods for the Preparation of Tetrahydrooxazines Amides

Sugar amine (e.g., glucamine) was dissolved in refluxing solvent such as methanol for 2 to 4 hours with stirring until solution turned clear. Other solvents which could be used include ethanol, propanol, isopropanol, ethylene glycol, propylene glycol, ethylene glycol monomethyl ether and diethylene glycol. The solution was cooled to room temperature and an aldehyde (e.g., formaldehyde or short chain aldehyde) solution was added. The reaction was allowed to go for about 20–30 hours and then all the solvent was removed under reduced pressure. This syrupy intermediate was not purified and was used for the next step. This material was dissolved in a solvent system (e.g., mixture of a 2:1 Dimethylformamide;pyridine solution) and acylated with the appropriate long chain acid chloride (1.0 to 1.5 equivalents) at 0° C. The product was purified by extraction and recrystallized in the, appropriate solvent.

Choice of aldehyde and choice of anhydride (or acyl chloride) determine length of $R_2$, $R_3$ and $R_1$, respectively. These are generally chosen such that, wherein $R_1$ is short chained (e.g., $C_1$ to $C_6$), $R_2$ and/or $R_3$ will be long chained (e.g., $C_8$ to $C_{40}$), preferably $C_{12}$ to $C_{30}$, more preferably $C_{12}$ to $C_{24}$; and when $R_1$ is long chained ($C_8$ to $C_{40}$), $R_2$ and/or $R_3$ are hydrogen or shod chain alkyl. While not wishing to be bound by theory, this is believed to be desirable in terms of optimizing the surfactancy of the molecule. $R_1$ plus $R_2$ plus $R_3$ should be at least $C_8$ or greater, preferably $C_{12}$ or greater.

Compositions

The surfactants of the invention may be used in cleansing or detergent composition such as heavy duty liquid detergents (generally enzyme containing) or powdered detergents. Examples of liquid or powdered detergents are described in U.S. Pat. No. 4,959,179 to Aronson (for liquid detergent compositions) and U.S. Pat. No. 4,929,379 Oldenburg et al. (for powdered compositions), both of which are incorporated herein by reference.

The liquid detergent compositions of the invention may be build or unbuilt and may be aqueous or nonaqueous. The compositions generally comprise about 5%–70% by weight of a detergent active material and from 0% to 50% of a builder. The liquid detergent compositions of the invention may further comprise an amount of electrolyte (defined as any water-soluble salt) whose quantity depends on whether or not the composition is structured. By structured is meant the formation of a lamellar phase sufficient to endow solid suspending capability.

More particularly, while no electrolyte is required for a non-structured, non-suspending composition, at least 1%, more preferably 15% by weight electrolyte is used. The formation of a lamellar phase can be detected by means well known to those skilled in the art.

The water-soluble electrolyte salt may be a detergency builder, such as the inorganic salt sodium tripolyphosphate or it may be a non-functional electrolyte such as sodium sulphate or chloride. Preferably, whatever builder is used in the composition comprises all or part of the electrolyte.

The liquid detergent composition generally further comprises enzymes such as proteases, lipases, amylases and cellulases which, when present, may be used in amounts from about 0.01 to 5% of the compositions. Stabilizers or stabilizer systems may be used in conjunction with enzymes and generally comprise from about 0.1 to 15% by weight of the composition.

The enzyme stabilization system may comprise calcium ion, boric acid, propylene glycol and/or short chain carboxylic acids. The composition preferably contains from about 0.01 to about 50, preferably from about 0.1 to about 30, more preferably from about 1 to about 20 millimoles of calcium ion per liter.

When calcium ion is used, the level of calcium ion should be selected so that there is always some minimum level available for the enzyme after allowing for complexation with builders, etc., in the composition. Any water-soluble calcium salt can be used as the source of calcium ion, including calcium chloride, calcium formate, calcium acetate and calcium propionate. A small amount of calcium ion, generally from about 0.05 to about 2.5 millimoles per liter, is often also present in the composition due to calcium in the enzyme slurry and formula water.

Another enzyme stabilizer which may be used is propionic acid or a propionic acid salt capable of forming propionic acid. When used, this stabilizer may be used in an amount from about 0.1% to about 15% by weight of the composition.

Another preferred enzyme stabilizer is polyols Containing only carbon, hydrogen and oxygen atoms. They preferably contain from 2 to 6 carbon atoms and from 2 to 6 hydroxy groups. Examples include propylene glycol (especially 1,2 propane diol which is preferred), ethylene glycol, glycerol, sorbitol, mannitol and glucose. The polyol generally represents from about 0.5% to about 15%, preferably from about 1.0% to about 8% by weight of the composition.

The composition herein may also optionally contain from about 0.25% to about 5%, most preferably from about 0.5% to about 3% by weight of boric acid. The boric acid may be, but is preferably not, formed by a compound capable of forming boric acid in the composition. Boric acid is preferred, although other compounds such as boric oxide, borax and other alkali metal borates (e.g., sodium ortho-, meta- and pyroborate and sodium pentaborate) are suitable. Substituted boric acids (e.g., phenylboronic acid, butane boronic acid and a p-bromo phenylboronic acid) can also be used in place of boric acid One especially preferred stabilization system is a polyol in combination with boric acid. Preferably, the weight ratio of polyol to boric acid added is at least 1, more preferably at least about 1.3.

With regard to the detergent active, the detergent active material may be an alkali metal or alkanolamine soap or a 10 to 24 carbon atom fatty acid, including polymerized fatty acids, or an anionic, a nonionic, cationic, zwitterionic or amphoteric synthetic detergent material, or mixtures of any of these.

Examples of the anionic synthetic detergents are salts (including sodium, potassium, ammonium and substituted ammonium salts) such as mono-, di- and triethanolamine salts of 9 to 20 carbon alkylbenzenesulphonates, 8 to 22 carbon primary or Secondary alkanesulphonates, 8 to 22 carbon primary or secondary alkanesulphonates, 8 to 24 carbon olefin sulphonates, sulphonated polycarboxylic acids prepared by sulphonation of the pyrolyzed product of alkaline earth metal citrates, e.g., as described in British Patent specification, 1,082,179, 8 to 22 carbon alkylsulphates, 8 to 24 carbon alkylpolyglycol-ether-sulphates, -carboxylates and -phosphates (containing up to 10 moles of ethylene oxide); further examples are described in "Surface Active Agents and Detergents" (Vol. I and II) by Schwartz, Ferry and Bergh. Any suitable anionic may be used and the examples are not intended to be limiting in any way.

Examples of nonionic synthetic detergents which may be used with the invention are the condensation products of ethylene oxide, propylene oxide and/or butylene oxide with 8 to 18 carbon alkylphenols, 8 to 18 carbon fatty acid amides; further examples of nonionics include tertiary amine oxides with 8 to 18 carbon alkyl chain and two 1 to 3 carbon alkyl chains. The above reference also describes further examples of nonionics.

The average number of moles of ethylene oxide and/or propylene oxide present in the above nonionics varies from 1–30; mixtures of various nonionics, including mixtures of nonionics with a lower and a higher degree of alkoxylation, may also be used.

Other examples of nonionic surfactants include the aldobionamides such as are taught in U.S. Ser. No. 931,737 to Au et al. and the hydroxy fatty acid amides such as described in U.S. Pat. No. 5,312,934 to Letton, both of which are incorporated by reference into the subject application.

Examples of cationic detergents which may be used are the quaternary ammonium compounds such as alkyldimethylammonium halogenides.

Examples of amphoteric or zwitterionic detergents which may be used with the invention are N-alkylamine acids, sulphobetaines condensation products of fatty acids with protein hydrolysates; but owing to their relatively high costs they are usually used in combination with an anionic or a nonionic detergent. Mixtures of the various types of active detergents may also be used, and preference is given to mixtures of an anionic and a nonionic detergent active. Soaps (in the form of their sodium, potassium and substituted ammonium salts) of fatty acids may also be used, preferably in conjunction with an anionic and/or nonionic synthetic detergent.

Builders which can be used according to this invention include conventional alkaline detergency builders,inorganic or organic, which can be used at levels from 0% to about 50% by weight of the composition, preferably,from 1% to about 20% by weight, most preferably from 2% to about 8%.

Examples of suitable inorganic alkaline detergency builders are water-soluble alkalimetal phosphates, polyphosphates, borates, silicates and also carbonates. Specific examples of such salts are potassium triphosphates, pyrophosphates, orthophosphates, hexametaphosphates, tetraborates, silicates and carbonates.

Examples of suitable organic alkaline detergency builder salts are: (1) water-soluble amino polycarboxylates, e.g., sodium and potassium ethylenediaminetetraacetates, nitrilotriacetates and N-(2 hydroxyethyl)-nitrilodiacetates; (2) water-soluble salts of phytic acid, e.g., sodium and potassium phytates (see U.S. Pat. No. 2,379,942); (3) water-soluble polyphosphonates, including specifically, sodium, potassium and lithium salts of ethane-1-hydroxy-1, 1 diphosphonic acid; sodium, potassium and lithium salts of methylene diphosphonic acid; sodium, potassium and lithium salts of ethylene diphosphonic acid; ;and sodium, potassium and lithium salts of ethane-1,1,2-triphosphonic acid. Other examples include the alkali metal salts of ethane-2-carboxy-1,1-diphosphonic acid hydroxymethanediphosphonic acid, carboxyldiphosphonic acid, ethane-1-hydroxy-1,1,2-triphosphonic acid, ethane-2-hydroxy- 1,2,2-triphosphonic acid, propane-1,1,3,3-tetraphosphonic acid, propane-1,1,2,3-tetraphosphonic acid, and propane-1,2,2,3-tetraphosphonic acid; (4) water soluble salts of polycarboxylate polymers and copolymers as described in U.S. Pat. No. 3,308,067.

In addition, polycarboxylate builders can be used satisfactorily, including water-soluble salts of mellitic acid, citric acid, and carboxymethyloxysuccinic acid and salts of polymers of itaconic acid and maleic acid; other polycarboxylate builders include DPA (dipicolinic acid) and ODS (oxydisuccinic acid). Certain zeolites or aluminosilicates can be used. One such aluminosilicate which is useful in the compositions of the invention is an amorphous water-insoluble hydrated compound of the formula $Na_x(_yAlO_2SiO_2)$, wherein x is a number from 1.0 to 1.2 and y is 1, said amorphous material being further characterized by a $Mg^{++}$ exchange capacity of from about 50 mg, eg. $CaCO_3$/g. and a particle diameter of from about 0.01 micron to about 5 microns. This ion exchange builder is more fully described in British Patent No. 1,470,250.

A second water-insoluble synthetic aluminosilicate ion exchange material useful herein is crystalline in nature and has the formula $Na_z[(AlO_2)_y(SiO_2)]_xH_2O$, wherein z to y is in the range from 1.0 to about 0.5, and x is an integer from about 15 to about 264; said aluminosilicate ion exchange material having a particle size diameter from about 0.1 micron to about 100 microns; a calcium ion exchange capacity on an anhydrous basis of at least about 200 milligrams equivalent of $CaCO_3$ hardness per gram; and a calcium exchange rate on an anhydrous basis of at least about 2 g rams/gallon/minute/gram. These synthetic aluminosilicates are more fully described in British Patent No. 1,429,143.

In addition to the ingredients described hereinbefore, the preferred compositions herein frequently contain a series of optional ingredients which are used for the known functionality in conventional levels. While the detergent compositions are generally premised on aqueous, enzyme-containing detergent compositions, it is frequently desirable to use a phase regulant. This component together with water constitutes then the solvent matrix for the claimed liquid compositions. Suitable phase regulants are well-known in liquid detergent technology and, for example, can be represented by hydrotropes such as salts of alkylarylsulfonates having up to 3 carbon atoms in the alkyl group, e.g., sodium, potassium, ammonium and ethanolamine salts of xylene-, toluene-, ethyl benzene-, cumene-, and isopropyl benzene sulfonic acids. Alcohols may also be used as phase regulants. This phase regulant is frequently used in an amount from about 0.5% to about 20%, the sum of phase regulant and water is normally in the range from 35% to 65%.

The preferred composition herein can contain a series of further optional ingredients which are mostly used in additive levels, usually below about 5%. Examples of the like additives include: polyacids, suds regulants, opacifiers, antioxidants, bactericides, dyes, perfumes, brighteners and the like.

The beneficial utilization of the claimed compositions under various usage conditions can require the utilization of a suds regulant. While generally all detergent suds regulants can be utilized, preferred for use herein are alkylated polysiloxanes such as dimethylpolysiloxane, also frequently termed silicones. The silicones are frequently used in a level not exceeding 0.5%, most preferably between 0.01% and 0.2%.

It can also be desirable to utilize opacifiers inasmuch as they contribute to create a uniform appearance of the concentrated liquid detergent compositions. Examples of suitable opacifiers include: polystyrene commercially known as LYTRON 621 manufactured by Monsanto Chemical Corporation. The opacifiers are frequently used in an amount from 0.3% to 1.5%.

The compositions herein can also contain known antioxidants for their known utility, frequently radical scavengers in the art established levels, i.e., 0.001% to 0.25% (by reference to total composition). These antioxidants are frequently introduced in conjunction with fatty acids.

The liquid detergent compositions of the invention may also contain deflocculating polymers such as described in U.S. Pat. No. 5,071,586 to Kaiserman et al., hereby incorporated by reference.

When the liquid composition is an aqueous composition, the above ingredients make up for the whole formulation (a non-aqueous composition may contain up to about 5% water).

An ideal liquid detergent composition might contain (all percentages by weight):

(1) 5–70% detergent active;

(2) 0–50% builder;

(3) 0–40% electrolyte;

(4) 0.01–5% enzyme;

(5) 0.1–15% enzyme stabilizer;

(6) 0–20% phase regulant; and (7) remainder water and minors.

The detergent composition of the invention might also be a powdered detergent composition.

Such powdered compositions generally comprise from about 5–40% of a detergent active system which generally consists of an anionic, a nonionic active, a fatty acid soap or mixtures thereof; from 20–70% of an alkaline buffering agent; up to about 40% builder and balance minors and water.

The alkaline buffering agent may be any such agent capable of providing a 1% product solution with a pH of above, 11.5 or even 12. Advantageous alkaline buffering agents are the alkalimetalsilicates, as they decrease the corrosion of metal parts in washing machines, and in particular sodium ortho meta- or di-silicates, of which sodium metasilicate is preferred. The alkaline buffering agents are the alkalimetalsilicates, as they decrease the corrosion of metal pads in washing machines, and in particular sodium orthometa- or di-silicates, of which sodium metasilicate is preferred. The alkaline buffering agent is present in an amount of rom 0 to 70% by weight, preferably from 0 to 30% by weight.

In addition the compositions of the invention can and normally will contain detergency builders in an amount of up to 40% by weight and preferably from 5 to 25% by weight of the total composition.

Suitable builders include sodium, potassium and ammonium or substituted ammonium pyro- and tri-poly-phosphates, -ethylene diamine tetraacetates, -nitrilotriacetates, -ether polycarboxylates, -citrates, -carbonates, -orthophosphates,-carboxymethyloxysuccinates, etc. Other builders include dipicolinic acid (DPA) and oxydisuccinic acid (ODS), also less soluble builders may be included, such as e.g., an easily dispersible zeolite. Particularly preferred are the polyphosphate builder salts, nitrilotriacetates, citrates, carboxymethyloxysuccinates and mixtures thereof.

Other conventional materials may be present in minor amounts, provided they exhibit a good dissolving or dispersing behavior; for example sequestering agents, such as ethylenediamine tetraphosphonic acid; soil-suspending agents, such as sodium carboxymethylcellulose, polyvinylpyrrolidone or the maleic anhydride/vinylmethyl ether copolymer, hydrotropes; dyes; perfumes optical: brighteners; alkali-stable. enzymes; germicides; anti-tarnishing agents; lather depressants; fabric softening agents; oxygen- or chlorine-liberating bleaches, such as dichlorocyanuric acid salts or alkalimetal hypochlorides.

The remainder of the composition is water, which is preferably present in hydrated form, such as e.g., in the form of silicate 5 aq.

An ideal powdered detergent composition might contain the following (all percentages by weight);

(1) 5–40% detergent active;

(2) 0–40% builder;

(3) 0–30% buffer salt;

(4) 0–30% sulfate;

(5) 0–20% bleach system;

(6) 0–4% enzyme;

(7) minors plus water to 100%

The personal product compositions of tile invention may be, for example, soap bar compositions, facial or body cleansing compositions, shampoos for hair or body, conditioners (fabric or hair), or cosmetic compositions.

In one embodiment of the invention, the surfactant of the invention may be used, for example, in a toilet bar formulation.

Typical soap bar compositions are those comprising fatty acid soaps used in composition with a detergent other than fatty acid soap and free fatty acids. Mildness improving salts, such as alkali metal salt or isethionate, are also typically added. In addition other ingredients, such as germicides, perfumes, colorants, pigments, suds-boosting salts and anti-mushing agents may also be added.

Fatty acid soaps are typically alkali metal or alkanol ammonium slats of aliphatic alkane or alkene monocarboxylic acids. Sodium, potassium, mono-, di and tri-ethanol ammonium cations, or combinations thereof, are suitable for purposes of the invention. The soaps are well known alkali metal salts of natural or synthetic aliphatic (alkanoic or alkenoic) acids having about 8 to 22 carbons, preferably 12 to about 18 carbons. They may be described as alkali metal carboxylates of acrylic hydrocarbons having about 12 to 22 carbons.

Examples of soap which may be used may be found in U.S. Pat. No. 4,695,395 to Caswell et al. and U.S. Pat. No. 4,260,507 (Barrett), both of which are incorporated herein by reference.

Fatty acid soaps will generally comprise greater than 25% of the composition, generally from 30–98%. Preferably, the amount of soap will range from 40% to 70% by weight of the composition.

The compositions will also generally comprise a non-soap detergent which is generally chosen from anionic, nonionic, cationic, zwitterionic or amphoteric synthetic detergent materials or mixtures thereof. These surfactants are well known in the art and are described, for example, in U.S. Pat. Nos. 4,695,395 and 4,260,507 discussed above. These non-soap actives may comprise from 0 to 50% of the composition.

A certain amount of free fatty acids of 8 to 22 carbons are also desirably incorporated into soap compositions to act as superfatting agents or as skin feel and creaminess enhancers. If present, the free fatty acids comprise between 1 and 15% of the compositions.

A preferred mildness improving salt which may be added to soap compositions is a simple unsubstituted sodium isethionate. This may be present as 0.1 to 50% of the compositions, preferably 0.5% to 25%, more preferably 2% to about 15% by weight. Other mildness co-actives which may be used include betaine compounds or ether sulphates. These also may be present at 0.1 to 50% of the composition, preferably 0.5% to 25%.

The surfactant of the invention may comprise 0.01 to 45% by weight of the composition.

Other optional ingredients which may be present in soap bar compositions are moisturizers such as glycerin, propylene glycol, sorbitol, polyethylene glycol, ethoxylated or methoxylated ether of methyl glucose etc.; water-soluble polymers such as collagens, modified cellulases (such as Polymer JR®, guar gums and polyacrylates; sequestering agents such as citrate, and emollients such as silicones or mineral oil. Another useful set of ingredients are various cosurfactants and non-soap detergents.

In a second embodiment: of the invention the surfactant of the invention may be present in a facial or body cleansing composition. Examples of such cleaning compositions are described, for example, in U.S. Pat. No. 4,812,253 to Small et al. and U.S. Pat. No. 4,526,710 to Fujiwara, both of which are hereby incorporated reference.

Typically, cleansing compositions will comprise a fatty acid soap together witch a non-soap surfactant, preferably a mild synthetic surfactant. Cleaning compositions will also generally include a moisturizer or emollient and polymeric skin feel and mildness aids. The compositions may further optionally include thickener, conditioners, water soluble polymers, dyes, hydrotropes brighteners, perfumes and germicides.

The fatty acid soaps used are such as those described above in uses in detergent bar formulations. These soaps are topically alkali metal or alkanol ammonium salts of aliphatic or alkene monocarboxylic salts. Sodium, potassium, mono-, di- and triethanol ammonium cations, or combinations thereof are suitable. Preferred soaps are 8 to 24 carbon half acid salts of, for example, triethanolamine.

Surfactants can be chosen from anionic, nonionic, cationic, zwitterionic or amphoteric materials or mixtures thereof such as are described in U.S. Pat. No. 4,695,395 mentioned above, or in U.S. Pat. No. 4,854,333 to Inman et al., hereby incorporated by reference.

Moisturizers are included to provide skin conditioning benefits and improve mildness. This term is often used as synonymous with emollient and is then used to describe a material which imparts a smooth and soft feeling to skin surface.

There are two ways of reducing water loss from the stratum corneum. One is to deposit on the surface of the skim an occlusive layer which reduces the rate of evaporation. The second method is to add nonocclusive hydroscopic substances to the stratum corneum which will retain water, and make this water available to the stratum corneum to alter its physical properties and produce a cosmetically desirable effect. Nonocclusive moisturizers also function by improving the lubricity of the skin.

Both occlusive and nonocclusive moisturizers can work in the present invention. Some examples of moisturizers are long chain fatty acids, liquid water-soluble polyols, glycerin, propylene glycol, sorbitol, polyethylene glycol, ethoxylated/propoxylated ethers of methyl glucose (e.g., methyl gluceth-20) and ethoxylated/-propoxylated ethers of lanolin alcohol (e.g., Solulan 75).

Preferred moisturizers are coco and tallow fatty acids. Some other preferred moisturizers are the nonocclusive liquid water soluble polyols and the essential amino acid compounds found naturally in the skin.

Other preferred nonocclusive moisturizers are compounds found to be naturally occurring in the stratum corneum of the skin, such as sodium pyrrolidone carboxylic acid, lactic acid, urea, L-proline, guanidine and pyrrolidone. Examples of other nonocclusive moisturizers include hexadecyl, myristyl, isodecyl or isopropyl esters of adipic, lactic, oleic, stearic, isostearic, myristic or linoleic acids, as well as many of their corresponding alcohol esters (sodium isostearoyl-2 lactylate, sodium captyl lactylate), hydrolyzed protein and other collagen-derived proteins, aloe vera gel and acetamide MEA.

Some occlusive moisturizers include petrolatum, mineral oil, beeswax, silicones, lanolin and oil-soluble lanolin derivatives, saturated and unsaturated fatty alcohols such as benzyl alcohol, squalene and squalene, and various animal and vegetable oils such as almond oil, peanut oil, wheat germ oil, linseed oil, jojoba oil, oil of apricots pits, walnuts, palm nuts, pistachio nuts, sesame seeds, rapeseed, cod oil, corn oil, peach pit oil, poppyseed oil, pine oil, castor oil, soybean oil, avocado oil, safflower oil, coconut oil, hazelnut oil, olive oil, grape seed oil and sunflower seed oil.

Other examples of both types of moisturizers are disclosed in "Emollients—A Critical Evaluation," by J. Mausner, Cosmetics & Toiletries, May, 1981, incorporated herein by reference.

The polymeric skin feel and mildness aids useful in the present invention are the cationic, anionic, amphoteric, and the nonionic polymers used in the cosmetic field. Reduced skin irritation benefits as measured by patch testing of cationic and nonionic types of polymers are set out in "Polymer JR for Skin Care" Bulletin, by Union Carbide, 1977. The cationics are preferred over the others because they provide better skin feel benefits.

The amount of polymeric skin feel and mildness aids found useful in the composition of the present invention is from about 0.01% to about 5%, preferably from about 0.3% to about 4%. In bar compositions with less than 5.5% soap, the polymer is used at a level of 2% to 5%, preferably 3% or more.

Other types of high molecular weight polymeric skin feel and skin mildness aids, such as nonionic guar gums, Merquats 100 and 550, made by Merck & Co., Inc.; JAGUAR C-14-S made by Stein Hall; Mirapol A15 made by Miranol Chemical Company, Inc.; and Galactasol 811, made by Henkel, Inc.; plus others, are usable. The polymer also provides enhanced creamy lather benefits.

The nonionic polymers found to be useful include the nonionic polysaccharides, e.g., nonionic hydroxypropyl guar gums, offered by Celanese Corp. A preferred nonionic hydroxypropyl guar gum material is JAGUAR® HP-60 having molar substitution of about 0.6. Another class of useful nonionics is the cellulosic nonionic polymers, e.g., HEC and CMC.

The cationic polymers employed in this invention also provide a desirable silky, soft, smooth in-use feeling. The preferred level for this invention is 0.1–5% of the composition. There is a reason to believe that the positively charged cationic polymers can bind with negatively charges sites on the skin to provide a soft skin feel after use. Not to be bound by any theory, it is believed that the greater the charge density of the cationic polymer, the more effective it is for skin feel benefits.

Other suitable cationic polymers are copolymers of dimethylaminoethylmethacrylate and acrylamide and copolymers of dimethyldialkylammonium chloride and acrylamide in which the ratio of the cationic to neutral monomer units has been selected to give a copolymer having a cationic charge. Yet other suitable types of cationic polymers are the cationic starches, e.g., StaLok® 300 and 400 made by Staley, Inc.

A more complete list of cationic polymers useful in the present invention is described in U.S. Pat. No. 4,438,095 to Grolier/Allec, issued Mar. 20, 1984, incorporated herein by reference. Some of the more preferred cationics are listed in Column 3, Section 2; Column 5, Section 8; Column 8, Section 10; and Column 9, lines 10–15 of the Grolier/Allec patent, incorporated herein by reference.

In a third embodiment of the invention, the surfactant of the invention may be used, for example, in a bar or body shampoo. Examples of such compositions are described In U.S. Pat. Nos. 4,854,333 and 4,526,710 to Fugisawa, both of which are incorporated herein by reference.

The shampoo compositions which may be used typically comprises a surfactant selected from any one of a wide variety of surfactants known in the art (such as U.S. Pat. No. 4,854,333 incorporated herein by reference. The shampoo compositions may additionally comprise a compound considered useful for treating dandruff, e.g., selenium sulfide.

The compositions all may also optionally comprise a suspending agent, for example, any of several acryl derivative materials or mixtures thereof. Among these are ethylene glycol esters of fatty acids having 16 to 22 carbons. Preferred suspending agents include ethylene glycol stearates, both mono- and distearate. Preferred alkanol amides are stearic monoethanolamide, stearic diethanolamide and stearic monoisopropanolamide. Still other long chain acyl derivatives include long chain esters of long chain fatty acids (e.g., styrol stearate, cetyl palmitate), glyceryl esters (e.g., glyceryl distearate), and long chain esters of long chain alkanol amides (e.g., stearamide DEA distearate, stearamide MEA stearate).

Still other suitable suspending agents are alkyl (16 to 22 carbon) dimethyl amine oxides, such as stearyl dimethyl amine oxide. If the compositions contain an amine oxide or a long chain acyl derivative as a surfactant, these components may also provide the suspending function and additional suspending agent may not be needed.

Xanthan gum is another aspect used to suspend, for example, selenium sulfide which may be in the present compositions. This biosynthetic gum material is commercially available and is a heteropolysaccharide with a molecular weight of greater than 1 million. It is believed to contain D-gtucose. D-mannose and D-glucoronate in the molar ratio of 2.8:2.0:2.0.The polysaccharide is partially acetylated with 4.7% acetyl. Supplemental information on these agents is found in Whistler, Roy L. (Editor), Industrial Gums—Polysaccharides and Their Derivatives New York: Academic Press, 1973. Kelso, a Division of Merck & Co., Inc., offers xanthan gum as Keltrol R.

A particularly preferred suspending system comprises a mixture of xanthan gum, present at a level of from about 0.05% to about 1.0%, preferably from about 0.2% to about 0.4%, of the compositions, together with magnesium aluminum silicate ($Al_2Mg_8Si_2$), present at a level of from 0.1% to about 3.0%, preferably from about 0.5% to about 2.0%, of the compositions. Magnesium aluminum silicate occurs naturally in such smectite minerals as colerainite, saponite and sapphire. Refined magnesium aluminum silicates useful herein are readily available, for example, as veegum, manufactured by R. T. Vanderbilt Company, Inc. Mixtures of suspending agents are also suitable for use in the compositions of this invention.

Other useful thickening agents are the cross-linked polyacrylates such as those manufactured by B. F. Goodrich and sold under the Carbopol® tradename.

Another optional component for use in the present compositions is an amide. The amide used in the present compositions can be any of the alkanolamides of fatty acids known for use in shampoos. These are generally mono- and diethanolamides of fatty acids having from about 8 to 24 carbon atoms. Preferred are coconut monoethanolamide, lauric diethanolamide and mixtures thereof. The amide is present at a level of from about 1% to about 10% of the compositions.

The compositions may also contain nonionic polymer material which is used at a low level to aid dispersing particles. The material can be any of a large variety of types including cellulosic materials such as hydroxypropyl methyl cellulose, carboxymethyl cellulose, hydroxyethyl cellulose and sodium carboxymethyl cellulose as well as mixtures of these materials. Other materials include alginates, polyacrylic acids, polyethylene glycol and starches, among many others. The nonionic polymers are discusses in detail in *Industrial Gums*, edited by Roy L. Whistler, Academic Press, Inc., 1973, and *Handbook of Water-Soluble Gums and Resins*, edited by Robert L. Davidson, McGraw-Hill Inc., 1980. Both of these books in their entirety are incorporated herein by reference.

When included, the nonionic polymer is used at a level of from about 0.001% to about 0.1%, preferably from about 0.002% to about 0.05%, of the composition. Hydroxypropyl methyl cellulose is the preferred polymer.

Another suitable optional component useful in the present composition is a nonvolatile silicone fluid.

The nonvolatile silicone fluid may be either a polyalkyl siloxane, a polyaryl siloxane, a polyalkylaryl siloxane or a polyether siloxane copolymer and is present at a level of from about 0.1% to about 10.0%, preferably from about 0.5% to about 5.0%. Mixtures of these fluids may also be used and are preferred in certain executions. The dispersed silicone particles should also be insoluble in the shampoo matrix. This is the meaning of "insoluble" as used herein.

The essentially nonvolatile polyalkyl siloxane fluids that may be used include,, for example, polydimethyl siloxanes with viscosities ranging from about 5 to about 600,000 centistokes at 25° C. These siloxanes are available, for example, from the General Electric Company as the Viscasil series and from Dow Corning as the Dow Corning 200 series. The siloxane viscosity can be measured by means of a glass capillary viscometer as set forth in Dow Corning Corporate Test Method CTMO004, Jul. 20, 1970. Preferably the viscosity of these siloxanes range from about 350 centistokes to about 100,000 centistokes.

The essentially nonvolatile polyether siloxane copolymer that may be used is, for example, a polypropylene oxide modified dimethylpolysiloxane (e.g., Dow Corning DC-1248), although ethylene oxide or mixtures of ethylene oxide and propylene oxide may also be used.

Suitable silicone fluids are described in U.S. Pat. No. 2.826,551, Geen; U.S. Pat. No. 3,946,500, Jun. 22, 1976, Drakoff; U.S. Pat. No. 4,364,837, Pader; and British Patent 849,433, Woolston. All of these patents are incorporated herein by reference. Also incorporated herein by reference is Silicon Compounds, distributed by Petrarch Systems, Inc., 1984. This reference provides a very good listing of suitable silicone materials.

Another silicone material useful is silicone gum. Silicone gums are described by Petrarch and others including U.S. Pat. No. 4,152,416, May 1, 1979, Spitzer,et al., and Nol, *Chemistry and Technology of Silicones*, New York, Academic Press, 1968. Useful silicone gums are also described in General Electric Silicone Rubber Product Data Sheets SE 30, SE 33, SE 54 and SE 76. All of these references are incorporated herein by reference. "Silicone gum" materials denote high molecular weight polydiorganosiloxanes having a mass molecular weight of from about 200,000 to about 1,000,000. Specific examples include polydimethylsiloxane, (polydimethylsiloxane) (methylvinylsiloxane) copolymer, poly(dimethylsiloxane) (diphenyl) (methylvinylsiloxane) copolymer, and mixtures thereof. Mixtures of silicone fluids and silicone gums are also useful herein.

The shampoos herein can contain a variety of other nonessential optional components suitable for rendering such compositions more formulatable, or aesthetically and/or cosmetically acceptable. Such conventional optional ingredients are well-known to those skilled in the art and include, e.g., preservatives, such as benzyl alcohol, methyl paraben, propyl paraben, and imidazolinidyl urea; cationic surfactants, such as cetyl trimethyl ammonium chloride, lauryl trimethyl ammonium chloride, tricetyl methyl ammonium chloride, stearyldimethyl benzyl ammonium chloride, and di(partially hydrogenated tallow) dimethylammonium chloride; menthol; thickeners and viscosity modifiers, such as block polymers of ethylene oxide and propylene oxide such as Pluronic F88 offered by BASA Wyandotte, sodium chloride,, sodium sulfate, propylene glycol, and ethyl alcohol; pH adjusting agents, such as citric acid, succinic acid, phosphoric acid, sodium hydroxide, sodium carbonate; perfumes; dyes; and sequestering agents, such as disodium ethylenediamine tetraacetate. Such agents generally are used individually at a level of from about 0.01% to about 5.0%, of the composition.

In a fourth embodiment of the invention, the surfactant of the invention may be used in a conditioner compositions (hair conditioner or fabric conditioner) such as is taught and described in U.S. Pat. No. 4,913,828 to Caswell et al. which is hereby incorporated by reference.

More particularly, conditioner compositions are those containing a conditioning agent (e.g., alkylamine compounds) such as those described in U.S. Pat. No. 4,913,828.

In a fifth embodiment of the invention, the surfactant may be used in a cosmetic composition, such as is taught and is described in EP 0,371,803.

Such compositions generally comprise thickening agents, preservatives and further additions.

The composition may comprise polymer thickener in an amount sufficient to adjust the viscosity of the composition, so as to facilitate dispensing it conveniently onto the body surface.

Examples of polymer thickeners include: anionic cellulose materials, such as sodium carboxy methyl cellulose; anionic polymer such as carboxy vinyl polymers, for example, Carbomer 940 and 941; nonionic cellulose materials, such as methyl cellulose and hydroxy propyl methyl cellulose; cationic cellulose materials, such as Polymer JR 400; cationic gum materials, such as Jaguar C13 S; other gum materials such as gum acacia, gum tragacanth,locust bean gum, guar gum and carrageenan; proteins, such as albumin and protein hydrolysates; and clay materials,such as bentonite, hectorite, magnesium aluminum silicate, or sodium magnesium silicate. Generally, the thickening agent may comprise from 0.05% to 5%, preferably 0.1 to 1% by weight of the composition.

The composition according to the invention can also optionally comprise a preservative to prevent microbial spoilage.

Examples of preservatives include:

(i) Chemical preservatives, such as ethanol, benzoic acid, sodium benzoate, sorbic acid, potassium sorbate, sodium propionate and the methyl, ethyl, propyl and butyl esters of p-hydroxybenzoic acid 2-bromo-2-nitropropane-1,3-diol, phenoxyethanol, dibromodicyanobutane, formalin and Tricolsan. The amount-of chemical preservative optionally to be incorporated in the composition according to the invention will generally be from 0.05 to 5%, preferably from 0.01–2% by weight, the amount chosen being sufficient to arrest microbial proliferation.

(ii) Water activity depressants, such as glycerol, propylene glycol, sorbitol, sugars and salts, for examples alkali metal halides, sulphates and carboxylates. When employing a water activity depressant, sufficient should be incorporated in the composition according to the invention to reduce the water activity ($\alpha_\omega$) from 1 to <0.9, preferably to <0.85 and most preferably <0.8, the lowest of these values being that at which yeasts, molds and fungi will not proliferate.

The composition can also contain other optional adjuncts, which are conventionally employed in compositions for topical application to human skin. These adjuncts, when present, will normally form the balance of the composition.

Examples of optional adjuncts include vehicles, the selection of which will depend on the required product form of the composition. Typically, the vehicle when present, will be chosen from diluents, dispersants or carriers for the dialkyl or dialkenylphosphate salt so as to ensure an even distribution of it when applied to the skin.

Compositions according to this invention can include water as a vehicle, usually when at least one other cosmetically-acceptable vehicle.

Vehicles other than water that can be used in compositions according to the invention can include liquids or solids as emollients, solvents, humectans, thickeners and powders. Examples of each of these types of vehicles, which can be used singly or as mixtures of one or more vehicles, are as follows:

Emollients, such as stearyl alcohol, glyceryl monolaurate, glyceryl monoricinoleate, glyceryl monostearate, propane-1,2-diol, butane-1,3 diol, docosan-1,2-diol, mink oil, cetyl alcohol, isopropyl isostearate, stearic acid, isobutyl palmitate, isocetyl stearate, oleyl alcohol, isopropyl laurate, hexyl laurate, decyl oleate octadecan-2-ol, isocetyl alcohol, eicosanyl alcohol, behenyl alcohol, cetylpalmitate, silicone oils such as dimethylpolysiloxane, di-n-butyl sebacate, isopropyl myristate, isopropyl palmitate, isopropyl stearate, butyl stearate, polyethylene glycol, triethylene glycol, lanolin, cocoa butter, corn oil, cotton seed oil, tallow, lard, olive oil, palm kernel oil, rapeseed oil, safflower seed oil, soybean oil, sunflower seed oil, olive oil, sesame seed oil, coconut oil, arachis oil, castor oil, acetylated lanolin alcohols, petroleum, mineral oil, butyl myristate, isostearic acid, palmitic acid, isopropyl linoleate, lauryl lactate, myristyl lactate, decyl oleate, myristyl myristate;

Propellants, such as trichlorofluoromethane, dichlorodifluoromethane, dichlorotetrafluoromethane, monochlorodifluoromethane, trichlorotrifluoromethane, propane, butane, isobutane, dimethyl ether, carbon dioxide, nitrous oxide;

Solvents, such as ethyl alcohol, methylene chloride, isopropanol, acetone, castor oil, ethylene glycol monoethyl ether, diethylene glycol monobutyl ether, diethylene glycol monoethyl ether, dimethyl sulphoxide, dimethyl formamide, tetrahydrofuran;

Humectants, such as glycerin, sorbitol, sodium 2-pyrrolidone-5-carboxylate, soluble collagen, dibutyl phthalate, gelatin;

Powders, such as chalk, talc, fullers earth, kaolin, starch, gums, colloidal silicon dioxide, sodium polyacrylate, tetra alkyl and/or trialkyl aryl ammonium smectites, chemically modified magnesium aluminum silicate, organically modified montmorillonite clay, hydrated aluminum silicate, fumed silica, carboxyvinyl polymer, sodium carboxymethyl cellulose, ethylene glycol monostearate.

The cosmetically acceptable vehicle, when present, will usually form from 0.01 to 99.9%, preferably from 59 to 913% by weight of the composition, and can, in the absence of other cosmetic adjuncts, form the balance of the composition.

A wide variety of conventional sunscreening agents, such as those described in U.S. Pat. No. 4,919,934 to Deckner et al. hereby incorporated by reference, may also be used in the cosmetic compositions of the invention.

Such agents include, for example, p-Aminobenzoic acid, its salts and its derivatives, anthranilates, salicylates, cinnamic acid derivatives, di- and trihydroxy cinnamic acid derivatives, hydrocarbons such as diphenylbutadiene and stilbene, dibenzalacetone and benzalacetophenone, naphthasulfonates, di-hydroxy naphtholic acid and its salts, hydroxy diphenylsulfonate, coumarin derivatives, diazones, quinine salts, quinoline derivatives, hydroxy or methoxy substituted benzophenones, uric or vilouric acid, tannic acid and its derivatives, hydroquinone, and benzophenones.

In a sixth embodiment of the invention, the molecule of the invention may be used in a light duty liquid detergent composition such as those taught in U.S. Pat. No. 4,671,894 to Lamb et al., which patent is also hereby incorporated by reference.

Generally such compositions comprise a mixture of sulphate and sulphonate anionic surfactants together with a suds stabilizing agent. These compositions may also comprise nonionic surfactants designed to reduce the level of non-performing ingredients such as solvents and hydrotropes and zwitterionic surfactants for providing enhanced grease and particulate soil removal performance.

Among other ingredients which may also be used in such compositions are opacifiers (e.g., ethylene glycol distearate), thickeners (e.g., guar gum), antibacterial agents, antitarnish agents, heavy metal chelators (e.g., ETDA), perfumes and dyes.

In an seventh embodiment of the invention the molecule of the invention may be used in underarm deodorant/antiperspirant compositions such as those taught in U.S. Pat. No. 4,919,934 to Deckner, U.S. Pat. No. 4,944,937 to McCall and U.S. Pat. No. 4,944,938 to Patini, all of which patents are hereby incorporated by reference.

Such compositions generally comprise a cosmetic stick (gel or wax) composition which in turn generally comprises one or more liquid base materials (e.g., water, fatty acid and fatty alcohol esters, water-insoluble ethers and alcohols, polyorganosiloxanes); a solidifying agent for solidifying the liquid base; and an active component such as bacteriostat or fungistats (for antideodorant activity) or astringent metallic salts (for antiperspirant activity).

These compositions may also comprise hardeners, strengtheners, emollient, colorants, perfumes and emulsifiers and fillers.

While various compositions are described above, these should not be understood to be limiting as to what other personal product compositions may be used since other compositions which may be known to those of ordinary skill in the art are also contemplated by this invention.

Unless stated otherwise, all percentages which may be mentioned are percentages by weight.

The following examples are intended to further illustrate the invention and are not intended to limit the invention in any way.

Materials

The reagents used in preparation of the Oxazolidineacetamide surfactants for use in detergent compositions are as follows:

Reagents: D-Glucamine (Janssen Chemica); dodecyl aldehyde (Aldrich) tetradecyl aldehyde (Aldrich); acetic anhydride (Fisher Scientific).

EXAMPLE 1

Preparation of $C_{12}$ Oxazolidine Acetamide

In a 2-neck 2-liter round bottom flask was added D-Glucamine (30 g, 0.166 moles) and 1.5 liters of anhydrous methyl alcohol. The reaction was stirred (via magnetic stir bar) and refluxed using an oil bath. After vigorous refluxing, the solution went clear and the reaction was cooled to room temperature. Dodecyl aldehyde (33.05 g, 0.179 moles) and 1.1 g of anhydrous p-toluenesuiphonic acid was added to the reaction. The reaction was refluxed for 24 hours and then cooled to 10° C. using an ice bath. Addition of acetic anhydride (17.80 g, 0.174 moles) soon followed and the reaction was allowed to run at room temperature for an additional 12 hours.

The reaction was worked up by removal of the methanol solvent. Recrystallization in acetone gave approximately 65 g of crude material. Further analysis indicated that the this material contained two diastereomers as analyzed by NMR and mass spectrometry. The two pure diastereomers were isolated by chromatography under the following conditions:

Column chromatography was done on a column packed with $C_{18}$—(Regis) Bodman Biochrom. 1040 using ODS FEC PQ packing material. The solvent used was 55:45 $CH_3CN:H_2O$.

After separation, the purity was analyzed by HPLC as follows:

A column having the dimensions 5 μm×15 cm×4.6 cm was packed with spherisorb hexyl using the mobile phase containing the following solvent: 30%/30%/40% $CH_3OH/CH_3CN/H_2O$ (volume percent). 14 g/L NaCIO4 (Sodium perchlorate) was used in the solvent system and column temperature was 35° C.

One of the diastereomers showed the following characteristics:

$^{13}C$ NMR in $CD_3OD$: 14.48, 21.96, 23.22, 23.75, 24.36, 24.44, 30.50, 30.65, 30.74, 30.81, 33.09, 34.20, 64.73, 71.95, 72.31, 72.36, 72.46, 72.69, 80.22, 80.56, 90.58, 90.81,170.10, 170.73.

EXAMPLE 2

Preparation of $C_{14}$ Tetahydrooxazine Amide

A solution of glucamine (20 g) and 500 ml of methanol was heated for 2 hours under reflux. The solution was cooled to room temperature and then 37% formaldehyde solution (10.8 ml) was added followed by addition of p-toluenesulphonic acid (2 g). The reaction mixture was stirred at room temperature overnight. The solvent was removed by azeotropic distillation with toluene. The crude oxazolidine was not purified.

To a solution of tetrahydrooxazine of glucamine (22 g, 0.113 moles) in dry dimethylformamide (50 ml) was added dry pyrridine (25 ml). The solution was cooled to 0° C. using an ice bath. Myristoyl chloride (35.59 ml, 0.13 moles) was added portionwise over a 15 minute period. The reaction was stirred for 3 hours at 0° C. and then room temperature overnight. Ice was added to the reaction and then extracted with methylene chloride (3×200 ml) and then dried over anhydrous sodium sulfate. Filtering the sodium sulfate and removal of the solvent gave the crude product which further recrystallized from acetonitrile:water (8:2). The pure product was analyzed by NMR, IR, and mass spectrometry.

EXAMPLE 3

Critical Micelle Concentration (CMC)

The CMC is defined as the concentration of a surfactant at which it begins to form micelles in solution. Specifically, materials that contain both a hydrophobic group and a hydrophilic group (such as surfactants) will tend to distort the structure of the solvent (i.e., water) they are in and therefore increase the free energy of the system. They therefore concentrate at the surface, where, by orienting so that their hydrophobic groups are directed away from the solvent, the free energy of the solution is minimized. Another means of minimizing the free energy can be achieved by the aggregation of these surface-active molecules into clusters or micelles with their hydrophobic groups directed toward the interior of the cluster and their hydrophilic groups directed toward the solvent.

The value of the CMC is determined by surface tension measurements using the Wiihemy plate method. While not wishing to be bound by theory, it is believed that a low CMC is a measure of surface activity (i.e., lower CMC of one surfactant versus another indicates the surfactant with lower CMC is more surface active). In this regard, it is believed that lower CMC signifies that lesser amounts of a surfactant are required to provide the same surfactancy benefits as a surfactant with higher CMC.

The Critical micelle concentration of C12 Oxazolidine acetamide was measured by first dissolving it above the Krafft point and then measuring at 250° Celcius and it was found to be $1.78\times10^{-5}$M. This was accomplished using the DeNouy ring method. A Lauda TE-1C Tensiometer was used for the experiment. By comparison, the CMC for a heptaethoxylated dodecyl alcohol (typical nonionic) is $7.3\times10^{-5}$M (at 40° C.). Thus, it can be seen that CMC values for these oxazolidines and commercially available ethoxylated alcohols (i.e, $C_{12}$ EO7) are comparable.

EXAMPLE 4

Krafft Point

The Krafft temperature of the Oxazolidine surfactants were measured by making 0.10% solutions of surfactants in 100 ml glass jars 0.050 g of the surfactant was added to 50 g of water and stirred with a magnetic stir bar. The mixture was stirred and slowly heated by using a water bath. The Krafft point temperature of the surfactant was at the temperature where all the solid surfactant went into solution. The Krafft temperatures are summarized below.

| Surfactant | Krafft Temperature |
|---|---|
| C12 Oxazolidine Acetamide | 36–37° Celcius |

-continued

| Surfactant | Krafft Temperature |
|---|---|
| C14 Oxazolidine Acetamide | 39–40° Celcius |

Once again, those values are comparable to other well known commercially available surfactants indicating that the oxazolidines of the invention are a viable alternative to those other surfactants.

Moreover, the Krafft point was lower than the measured Krafft point for $C_{12}$ N-methyl glucamide (one of polyhydroxy amide compounds disclosed by Procter and Gamble), which was found to have a Krafft point of 45.3° C.

EXAMPLE 5

Foam Height

The Ross-Miles method was done in the typical Ross-Miles apparatus (see Ross, J. and Miles, G. D. Am. Soc. for Testing Material Method D1173-53 Philadelphia, Pa. (1953); Oil and Soap (1958) 62:1260).

The $C_{12}$ oxazolidine acetamide was dissolved above the Krafft point and a 200 ml solution of the surfactant (0.10% concentration) contained in a pipette of specified dimensions with a 2.9 mm i.d. opening was allowed to fall 90 cm onto 50 ml of the same solution contained in a glass vessel maintained at various temperatures by means of a water jacket. The height of the foam was read immediately and final foam height was read after a period of 30 minutes although generally it was done after 5 minutes.

This measurement was done at room temperature (25° C.).

| Compound | Foam Height (Initial) | Foam Height (Final) |
|---|---|---|
| C12 Oxazolidine | 154.185 mm | 134.185 |

The values are good values indicating that the surfactant is a good foamer.

EXAMPLE 6

The detergency of the oxazolidine acetamide surfactants were measured on WFK fabrics. The specific cloths used in this test was the WFK-30D cloths. This cloth is a polyester cloth soiled with pigment/sebum.

The WFK synthetic pigment mixture consists of:

| | |
|---|---|
| 86% | Kaolinite |
| 8% | flame soot 101 |
| 4% | iron oxide (black) |
| 2% | iron oxide (yellow) |

This is applied in a concentration of 7.5 g/l. The solution also contains 20 g/l of synthetic sebum which consists of:

| | |
|---|---|
| 18.0% | free fatty acids |
| 32.8% | beef tallow |
| 3.6% | fatty acid triglycerides |
| 18.3% | lanoline |
| 3.7% | cholesterol |
| 12.0% | hydrocarbon mixture |
| 11.6% | cutina |

These mixed solutions are sprayed onto the fabrics in an amount of 150 ml per m of fabric. This correlates to an application of 1 g/m$^2$ of the pigment mixture and 6 (respectively 3) g/m$^2$ of lanoline (synthetic sebum).

These WFK-30D cloths were cut into 4"×3" dimensions and their initial refractometer values recorded (front and back).

These cloths were washed in the conditions shown below:

| | |
|---|---|
| Apparatus: | Terg-O-Tometer UR 7227 |
| Wash Times; | 15 minutes |
| Agitation: | 100 rpm |
| Wash liquid volume: | 1000 ml. |
| Dosage: | approximately 1.0 g/l. |
| Total surfactant level: | 0.22 g/L |
| Zeolite 4A: | 0.45 g/L |
| Sodium carbonate: | 0.30 g/L |
| pH: | 10.0 |
| Hardness | 120.0 ppm as 2:1 Ca:Mg |
| Temperature | 40 and 25 Celcius |
| Test cloth/pot | Four - 3" × 4" swatches per pot. |

Equipment used:

The detergency is measured by change in reflectance values (delta R) between the soiled cloth and cloth after wash in the tergotometer. The cloths were measured on a BYK Gardner Cologuard 2000/05 Reflectometer. Standard commercially available surfactants were run side by side to compare delta R readings with that of our surfactant. The C12 Oxazolidine acetamide surfactant was run by itself and with combinations of co-surfactants. The results are shown below.

| Surfactant | Delta R | Temperature (°C.) |
|---|---|---|
| $C_{12}$ Oxazolidine | 24.75 | 25° C. |
| $C_{12}$ Oxazolidine | 21.5 | 40° C. |
| Neodol 25-7 | 21.53 | 25° C. |
| Neodol 25-7 | 18.09 | 40° C. |

Based on these results, the $C_{12}$ Oxazolidine acetamide is comparable or better than commercially available Neodol 25-7 (C12–C15 alcohol with average of 7 EO units) at 25° to 40° C. under these conditions.

EXAMPLE 7

| Ingredients | % by Weight |
|---|---|
| $C_{8-24}$ fatty acid soap | 30–95% |
| Surfactant of Invention | 0–45% |
| Alkyl sulfate | 0–5% |
| Moisturizer (e.g. Sorbitol or Glycerin | 0.1–10% |
| Water soluble polymer (e.g., Cellulase or Polyacrylates) | |
| Sequestering agents (e.g., citrate) | 0.1–0.5% |
| Dye stuff | <0.1% |
| Optical brighteners | <0.1% |
| Whitening agents | 0.1–0.4% |
| Fragrance | 0.1–2.0% |
| Water | Balance |

EXAMPLE 8

| Surfactant of Invention is used in Facial/Body Cleanser | |
|---|---|
| Ingredients | % by Weight |
| $C_{8-24}$ fatty acid salt (e.g., triethanolamine) | 1–45% |
| Surfactant of Invention | 10–75% |
| Alkyl sulfate | 0–20% |
| Coactive surfactants (e.g., cocoamidobetaine) | 1–15% |

-continued

| Surfactant of Invention is used in Facial/Body Cleanser | |
|---|---|
| Ingredients | % by Weight |
| Moisturizer (e.g., sorbitol) | 0.1–15% |
| Refattying alcohol | 0.1–5% |
| Water soluble polymer | 0–10% |
| Thickener | 0–15% |
| Conditioner (e.g., quaternized cellulose) | 0–0.5% |
| Sequestering agents (e.g., citrate) | 0.1–0.4% |
| Dye stuff | <0.1% |
| Optical brighteners | <0.1% |
| Whitening agents | 0.1–0.4% |
| Fragrance | 0.1–3.0% |
| Preservatives | 0–0.2% |
| Water | Balance |

We claim:

1. A detergent or personal product composition comprising:

(a) a compound selected from the group consisting of:

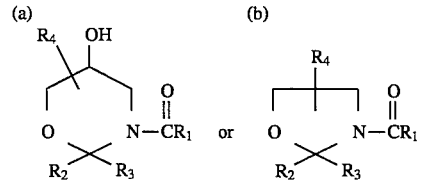

wherein:

$R_1$ is a linear or branched, saturated or unsaturated alkyl group having 1 to 50 carbons;

$R_2$ and $R_3$ are hydrogen or a linear or branched, saturated or unsaturated alkyl group having 1 to 50 carbons; and $R_4$ is —$(CHOH)_{n'}$—$CH_2OH$; wherein n' is 0 to 5; and (b) a detergency effective amount of a detergent additive selected from the group consisting of a surfacant, an enzyme and mixtures thereof.

2. A composition according to claim 1, wherein the starting sugar from which $R_4$ is derived is selected from the group consisting of glucose, fructose, maltose, lactose, galactose, mannose, xylose, erythritose and glyceraldehyde.

3. A composition according to claim 1, wherein the starting amino sugar from which $R_4$ is derived is glucamine or glucosamine.

4. A composition according to claim 1, wherein, in the 6-membered tetrahydrooxazine compound, $R_4$ is —$(CHOH)_{n'}$—$CH_2OH$; and wherein n' is 1 to 5.

5. An composition according to claim 1, wherein, in the 5-membered oxazolidine compound, $R_4$ is —$(CHOH)_{n'}$—$CH_2OH$; and wherein n' is 1 to 5.

6. A composition according to claim 4, wherein $R_2$=$R_3$= hydrogen and $R_1$=$C_{11}$ to $C_{17}$.

7. A composition according to claim 5, wherein $R_2$=hydrogen, $R_1$=$CH_3$ and $R_3$=$C_{11}$ to $C_{17}$.

8. A composition according to claim 1, which is a liquid detergent or powder detergent composition.

9. A detergent composition according to claim 8, wherein the composition is a liquid composition which additionally comprises:

(1) 0–50% by weight builder;

(2) 0–40% by weight electrolyte;

(3) 0.01–5% by weight enzyme;

(4) 0.1–15% by weight enzyme stabilizer;

(5) 0–2% by weight hydrotrope; and (6) 0–95% by weight water.

10. A powder composition according to claim 8, which additionally comprises:

(1) 5–40% by weight surfactant;

(2) 0–40% by weight builder;

(3) 0–30% by weight buffer salt;

(4) 0–30% by weight sulfate;

(5) 0–20% by weight bleach system;

(6) 0–4% by weight enzyme; and (7) 0 to 95% by weight water.

* * * * *